US006158914A

United States Patent [19]

Junkins

[11] Patent Number: 6,158,914

[45] Date of Patent: Dec. 12, 2000

[54] COMBINATION WRITING INSTRUMENT AND TOY

[76] Inventor: Mitchell Alan Junkins, 1409 High Bluff Dr., Newport Beach, Calif. 92660

[21] Appl. No.: 09/353,061

[22] Filed: Jul. 15, 1999

[51] Int. Cl.[7] ..... B43K 29/00

[52] U.S. Cl. ..... 401/195; 401/52

[58] Field of Search ..... 401/195, 52, 6, 401/7; 446/146

[56] References Cited

U.S. PATENT DOCUMENTS

| | | | |
|---|---|---|---|
| 3,639,069 | 2/1972 | Gordon . | |
| 4,076,427 | 2/1978 | Anderson | 401/6 |
| 4,983,062 | 1/1991 | Hour . | |
| 5,281,039 | 1/1994 | Hsiung et al. . | |
| 5,328,172 | 7/1994 | Jagiella . | |

FOREIGN PATENT DOCUMENTS

| | | |
|---|---|---|
| 10 38 961 | 3/1957 | Germany . |
| 30 49 467 | 7/1980 | Germany . |

*Primary Examiner*—Henry J. Recla
*Assistant Examiner*—Huyen Le
*Attorney, Agent, or Firm*—Morland C. Fischer

[57] ABSTRACT

A combination writing instrument and a toy which functions in one case as a writing instrument and in a second case as a toy. In the preferred embodiment, a conventional ball point pen cartridge is mounted within and projects from a base at which the cartridge is grasped by a writer. A plurality of colored disks or beads are stacked one above the other in surrounding engagement with the free end of the ball point pen cartridge. When the combination is not used in the capacity of a writing instrument, the disks and beads may be removed from the ball point pen cartridge and used as a play thing to occupy the time of the user. When the disks and beads are returned to the ball point pen cartridge, they may be arranged to form a variety of different patterns depending upon the order in which the disks and beads are stacked one above the other and the color, shape and size of the disks and beads to change the appearance of the combination and provide a puzzle-like quality.

10 Claims, 2 Drawing Sheets

22
8
14
24
14
2
1
12
10
4
6
22
24
14

1
12
4
18
14
16

COMBINATION WRITING INSTRUMENT AND TOY

BACKGROUND OF THE INVENTION

1. Field of the Invention.

This invention relates to a combination writing instrument (e.g. a ball point pen cartridge) and a toy having a plurality of removable disks and/or beads which can be removed from the writing instrument and used by children and adults, alike, as a play thing when the combination is not otherwise used in its capacity as a writing instrument.

2. Background Art.

Ball point pens have long been used as a low cost and convenient writing instrument. However, the outer casing of the ball point pen is typically manufactured from hard plastic. In this regard, gripping such a conventional ball point pen may become uncomfortable if the pen is used for writing over long periods of time. In some cases, the writer may have difficulty in carefully manipulating the pen when detailed illustrations or manuscripts are to be prepared.

What is more, conventional ball point pens have been used only as writing instruments. Should the writer become bored or need to pass time during quiet intervals of inactivity, the conventional ball point pen will be to no avail. In some cases, it may be desirable to have a small, readily available toy that can be manipulated simply to occupy the user's thoughts. In other cases, the user might wish to have a simple, easy to use toy to occupy the attention of a child. However, conventional ball point pens have not heretofore been used as a toy.

SUMMARY OF THE INVENTION

Accordingly, combinations are described which function in one case as a conventional writing instrument (e.g. a ball point pen). However, the combinations of this invention also function as a toy so as to enable adults and children, alike, to pass time by using each of the combinations, not in a writing capacity, but in the capacity of a hand-held play thing.

More particularly, in one embodiment of this invention, a conventional ball point pen cartridge is mounted within and projects from a base. The base has a smooth, arcuate thumb or finger pad formed therein to receive the writer's thumb or forefinger when the pen is used in a writing capacity. The distal end of the ball point pen cartridge is surrounded by a plurality of disks. In the assembled relationship, with the disks surrounding the ball point pen cartridge, a smooth, soft and continuous handle portion is provided for the ball point pen.

Each of the disks includes a base with a small head projecting outwardly therefrom. The heads of adjacent disks are sized to be received one within the other to establish the handle portion of the ball point pen. Each of the disks may be opaque, translucent or provided with different colors, letters, markings and/or symbols to enhance the aesthetic appeal of the pen, depending upon how the plurality of disks are positioned relative to one another around the ball point pen cartridge.

The distal tip of the ball point pen cartridge is threaded to receive a correspondingly threaded end cap. When the end cap is removed from the threaded tip of the cartridge, the disks surrounding the ball point pen cartridge may also be removed. At this point, the ball point pen functions as a toy such that the user may either play with the disks in and of themselves or rearrange the disks to form a variety of fanciful patterns when the disks are returned to surrounding engagement with the distal end of the ball point pen cartridge. In this regard, it may be appreciated that the combination of this invention functions as a traditional ball point pen while, at the same time, enabling both adults and children to remove the disks should it be necessary to have a small toy to occupy their time.

According to a second embodiment of the invention, a combination ball point pen and toy is described having a conventional ball point pen cartridge projecting from a gripping portion and a series of beads stacked one above the other in surrounding engagement with the distal end of the cartridge. The beads can be rectangular, oval, round or square and have different colors and transparencies. The exterior surface of the beads can be smooth or have groove patterns formed therein. An adult or child may remove the beads from the distal end of the pen cartridge for play or to simply pass time and then return them to their stacked alignment. However, the beads may be rearranged on the cartridge to establish any one of a multitude of different designs depending upon the size, shape and color of the beads so as to change the shape of the combination and preserve the puzzle like quality thereof.

DETAILED DESCRIPTION

Figures 1, 2, 3:
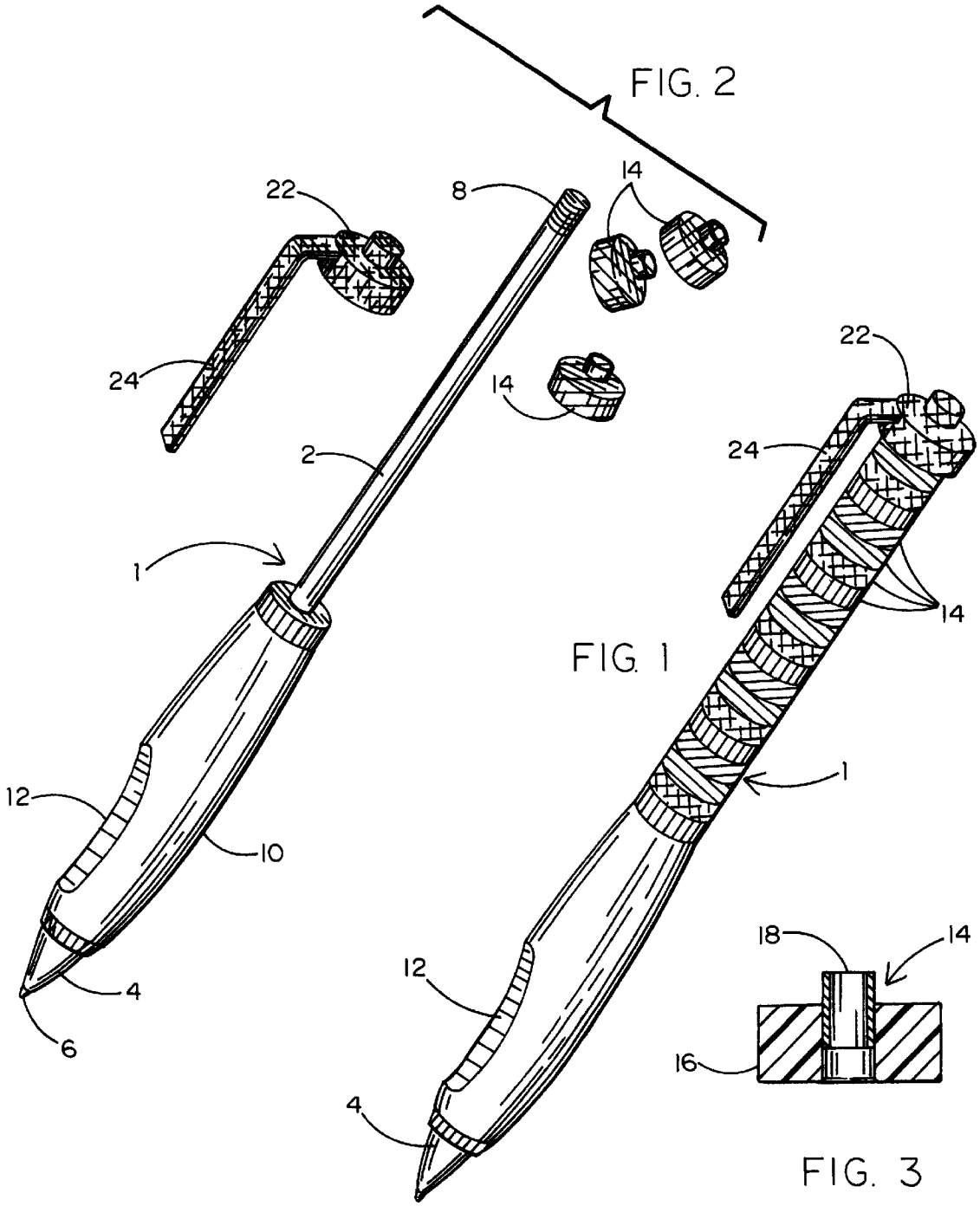
FIG. 1 is a perspective view of a combination ball point pen and toy which forms one embodiment of the present invention.
FIG. 2 is an exploded view of the combination ball point pen and toy of FIG. 1.
FIG. 3 is a cross-section of one of the disks illustrated in FIG. 1 and 2.

Referring concurrently to FIGS. 1 and 2 of the drawings, there is shown the combination 1 of a writing instrument and a toy which forms a first embodiment of the present invention. As is best shown in FIG. 1, the writing instrument is a conventional ball point pen cartridge 2 in which is stored a reservoir of ink. A narrow tip 4 to support a rolling ball 6 is located at the proximal end of cartridge 2. The distal tip of cartridge 2 has a series of screw threads 8 formed therearound for a purpose which will soon be described.

The proximal end of the ball point pen cartridge 2 extends longitudinally through and is mated to a relatively wide gripping portion 10. The gripping portion 10 is preferably manufactured from a plastic material. However, other non-plastic materials may also be used. A smooth, arcuate thumb or finger pad 12 is molded into the gripping portion 10 adjacent the proximal tip 4 of ball point pen cartridge 2. In use, the pad 12 is sized and shaped to receive the writer's thumb or forefinger therewithin. By virtue of the foregoing, the writer will be better able to control and manipulate the combination 1 when such combination is used in the capacity of a writing instrument. That is to say, the writer can accurately control the pen strokes should it be necessary to make fine lines, detailed drawings, or the like. Moreover, the relatively soft and wide construction of the gripping portion 10 enables the writer to more easily hold the pen so that less compressive forces will be required in this regard, whereby to minimize discomfort to the hand of the writer should the pen be used as a writing instrument for long periods of time.

The distal end of the ball point pen cartridge 2 is surrounded by a series of disks 14. It is to be understood that the precise number, size and shape of the disks 14 are not to be considered as limitations of the present invention and may vary from one writing instrument to another. Nevertheless, the number of disks 14 should be sufficient to completely surround the exposed distal end of the ball point pen cartridge 2 except for the threads 8 at the distal tip thereof It is preferable that each of the disks 14 be manufactured from a plastic material. Moreover, to enhance the aesthetic appearance of the combination 1 of a ball point pen and toy as well as provide the combination 1 with a puzzle-like quality, the disks 14 may be opaque, translucent, or provided with different colors, letters, markings and/or symbols so that the disks 14 can be distinguished from one another.

As is best shown in FIG. 3 of the drawings, each disk 14 has a base 16 with a hollow interior. Projecting outwardly from the base 16 of disk 14 is a hollow head 18 within which a metal insert is located. In the assembled configuration of the combination ball point pen and toy illustrated in FIG. 1, the disks 14 are stacked one above the other in surrounding engagement with the distal end of ball point pen cartridge 2 that projects outwardly from the gripping portion 10. Accordingly, the base 16 of a preceding disk 14 is received flush against the base 16 of a succeeding disk, and the head 18 of the preceding disk 14 is removably received within the hollow interior of the base 16 of the succeeding disk.

Once the disks 14 are stacked one above the other around the distal end of the ball point pen cartridge 2, a threaded end cap 22 is mated to the threads 8 of cartridge 2. The end cap 22 may include a suitable elongated clip arm 24 to perform the usual function when the pen is to be attached to the writer's pocket.

There may be times when the writer has free time to spend and nothing to occupy this free time. Such free time may occur between writing projects, as a passenger in an airplane or a train, or simply as part of an exercise to rest his mind from another activity. Alternatively, it may be desirable to keep a child busy for a short period of time when there are no toys or other play things readily available to occupy the child's attention. In this case, the combination 1 of a ball point pen and toy may advantageously perform the function of a toy.

More particularly, the user can remove the threaded end cap 22 from the threads 8 at the distal tip of the ball point pen cartridge 2. With end cap 22 removed, the user may remove the stack of disks 14 that surrounds the distal end of cartridge 2. An adult or a child can now play with the individual disks 14 that have been removed from the combination 1. Once the play time has elapsed, the disks 14 are returned to their stacked alignment one above the other as illustrated in FIG. 1. However, because the disks 14 have different appearances, they may be returned to the ball point pen cartridge 2 so as to establish a multitude of different patterns, any one of which being different from the pattern that was originally established by the stack of disks 14 prior to their removal from cartridge 2. In this regard, it may be appreciated that the disks 14 can be removed from the ball point pen cartridge 2 any number of times and then returned to cartridge 2 and rearranged to create a different pattern, the appearance of which is determined by the color, size and shape of the successive disks 14 that are stacked one above the other. This puzzle-like feature may prove to be particularly amusing to children and adults wishing to pass free time such as while waiting for a person to arrive or an event to occur or simply with nothing else to occupy their time.

Figure 4:
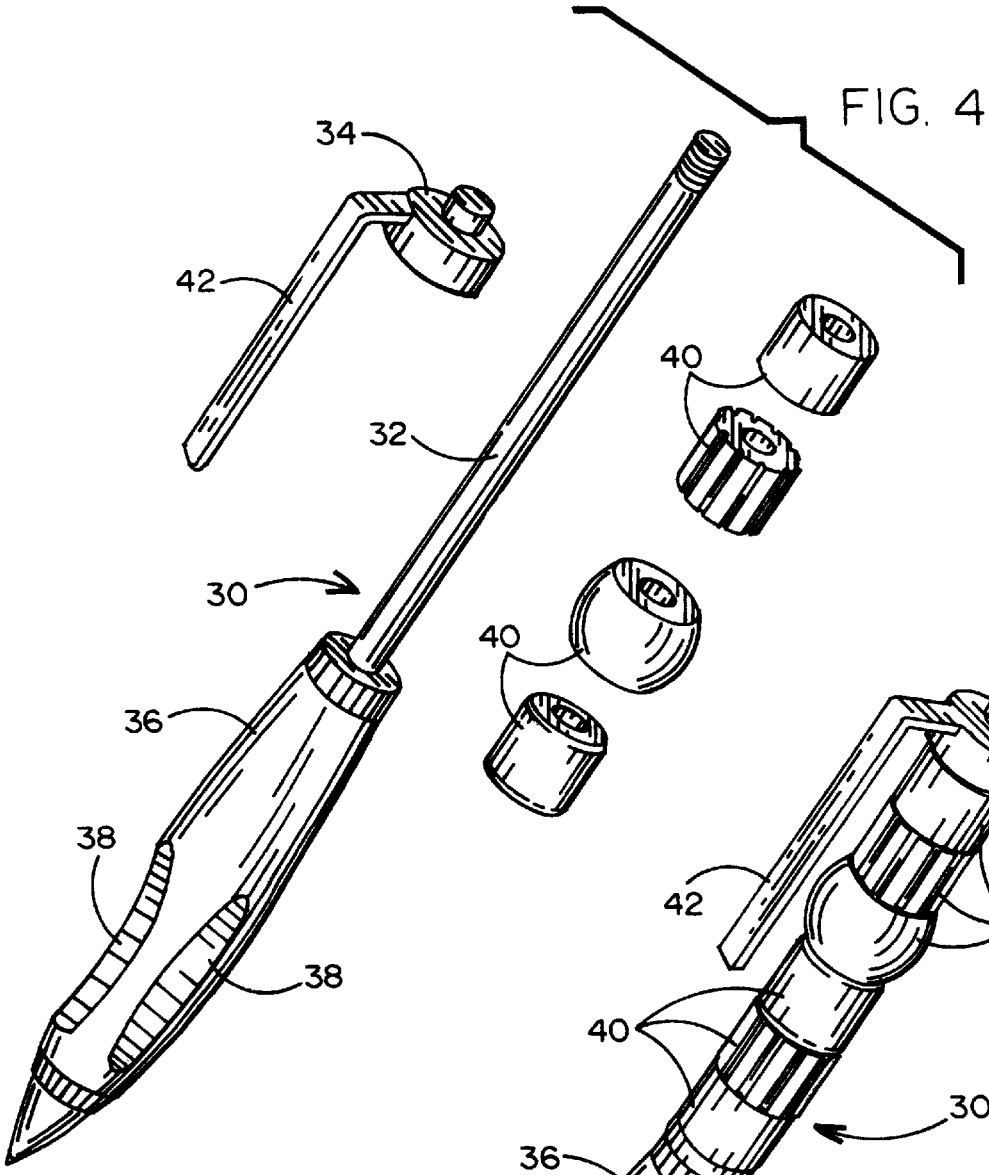
FIG. 4 is a perspective view of a combination ball point pen and toy which forms a second embodiment of this invention.
Figure 5:
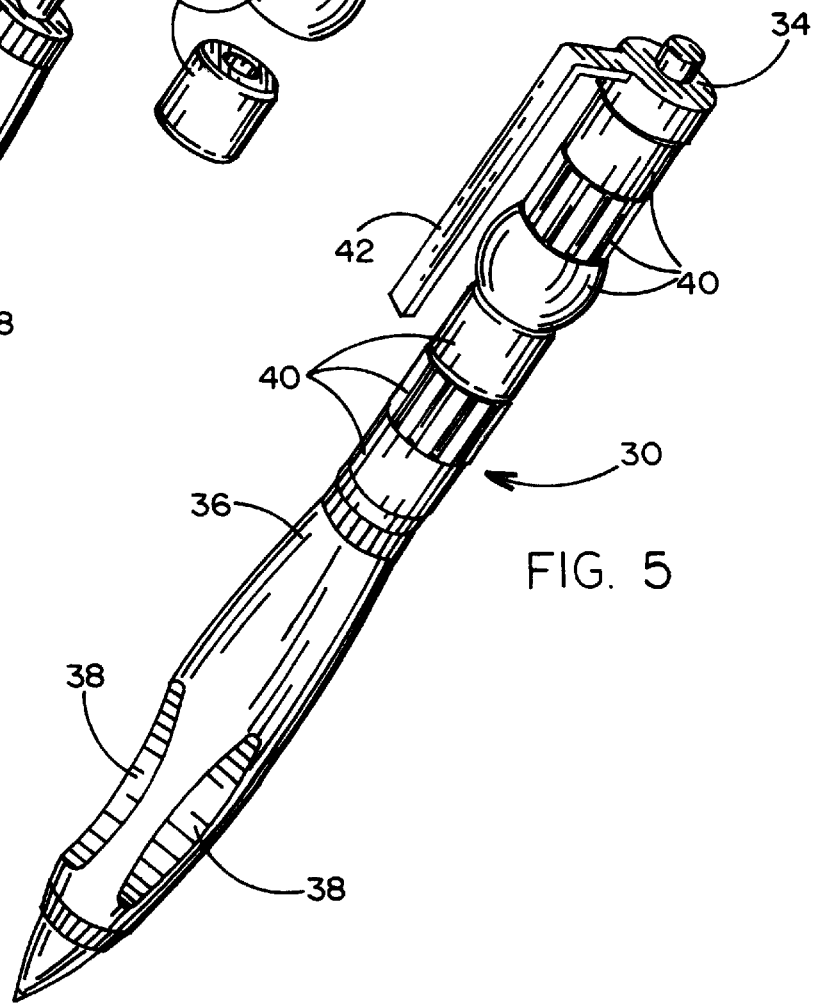
FIG. 5 is an exploded view of the combination ball point pen and toy of FIG. 4.

Turning now to FIGS. 4 and 5 of the drawings, there is shown a second combination 30 of a writing instrument and toy which forms another embodiment of this invention. Like the combination 1 that was previously described when referring to FIGS. 1–3, the combination 30 of this embodiment preferably includes a ball point pen cartridge 32. The distal tip of pen cartridge 32 is threaded to releasably engage a correspondingly threaded end cap 34. A gripping portion 36 of the combination 30 surrounds the proximal end of pen cartridge 32. In this case, a series of smooth, accurate thumb pads 38 are molded into the gripping portion 36. Thumb pads 38 extend around the periphery of gripping portion 36 in uniformly spaced alignment with one another.

According to the present embodiment, the distal end of the ball point pen cartridge 32 is surrounded by a series of beads 40. As in the combination 1 shown in FIGS. 1–3, the precise number, size and shape of the beads 40 are not to be regarded as a limitation of this invention and may vary from one writing instrument to another. By way of example only, the beads 40 can be rectangular, oval, round or square. The color and transparency of each bead 40 may be the same or vary from bead-to-bead. The exterior surface of the beads 40 may be smooth or have groove patterns formed therein. In fact, the combination 30 could include an assortment of the beads 40 shown in FIGS. 4 and 5 and the disks 14 shown in FIGS. 1–3. In either case, the beads 40, alone, or in combination with the disks 14 will enhance the appearance of the combination ball point pen and toy as well as provide the combination with a puzzle-like quality that may be used by children and adults, alike.

Each of the beads 40 of FIGS. 4 and 5 is manufactured so as to be stacked one above the other in surrounded engagement with the distal end of the ball point pen cartridge 32 that projects outwardly from the gripping portion 36. The manner in which each bead 40 is manufactured can be identical to the manufacture of the disks 14 that was described when referring to FIG. 3. In the alternative, the beads may simply have a narrow through hole that is sized to accommodate the cartridge 42. The end cap 34 follows the last of the series of beads 40 and is attached to the threaded distal tip of cartridge 42 to hold the beads 40 in place. The end cap includes the usual clip 42 and may take the shape of any of the beads 40.

The use of the combination 30 of FIGS. 4 and 5 as a toy is identical to the use of the combination 1 of FIGS. 1 and 2. That is to say, the user first removes the end cap 42 from the pen cartridge 32 to gain access to the beads 40. An adult or child may then remove the beads 40 for play and subsequently return them to their stacked alignment one above the other around the distal end of cartridge 32 as is best shown in FIG. 5. However, the beads 40 may be rearranged on cartridge 32 to establish any one of a multitude of different designs depending on the color, size and shape of the beads whereby to change the appearance of the combination 30 and enhance the puzzle-like quality thereof.

Unlike conventional writing instruments, the combinations 1 and 30 of a ball point pen and toy that have been described above perform multiple functions. The first function performed by the combinations is that of a conventional writing instrument. However, the same combinations 1 and 30 also perform the function of a small hand-held and easy to use toy or puzzle to occupy the time of both adults and children, alike. In this case, the elements which enable the combinations to function as a toy or puzzle are carried entirely on the ball point pen cartridge 2 and 32 and also cooperate to enhance the aesthetic appearance of the pen. What is more, the combinations 1 and 30 of this invention are not limited to a ball point pen cartridge but may include other writing instruments such as pencils, markers, and the like.

I claim:

1. A combination comprising:

a ball point pen cartridge having proximal and distal ends;

a gripping portion surrounding the proximal end of said ball point pen cartridge at which said cartridge is grasped, such that the distal end of said ball point pen cartridge projects outwardly from said gripping portion, said distal end having a series of screw threads formed therearound;

a plurality of play elements stacked one above the other and lying in surrounding engagement with the distal end of said ball point pen cartridge and adapted to be removed from said distal end to be used as a toy to occupy the time of a user; and an end cap having a complementary series of screw threads, such that said end cap is adapted to be removably attached to the series of screw threads formed around the distal end of said ball point pen cartridge to prevent the removal of said plurality of play elements from said distal end.

2. The combination recited in claim 1, wherein said end cap having said complementary series of screws threads and removably attached to the series of screw threads formed around the distal end of said ball point pen cartridge is one of said plurality of play elements lying in surrounding engagement with said distal end.

3. The combination recited in claim 2, further comprising a ball point pen clip attached to said end cap so as to depend from the one of said plurality of play elements.

4. The combination recited in claim 1, wherein said gripping portion surrounding the proximal end of said ball point pen cartridge is manufactured from a plastic material.

5. The combination recited in claim 4, wherein said gripping portion surrounding the proximal end of said ball point pen cartridge has an arcuate pad formed therein for receiving the thumb or finger of the user.

6. The combination recited in claim 1, wherein some of said plurality of play elements have different colors relative to one another to establish different patterns of colored play elements depending upon the order in which said plurality of play elements are stacked one above the other.

7. The combination recited in claim 6, wherein some of said plurality of play elements have different shapes relative to one another to establish different configurations of play elements depending upon the order in which said plurality of play elements are stacked one above the other.

8. The combination recited in claim 6, wherein said plurality of play elements includes a plurality of disks stacked one above the other and lying in surrounding engagement with the distal end of said ball point pen cartridge.

9. The combination recited in claim 1, wherein each disk of said plurality of disks has a hollow base and a head projecting from said hollow-base, said plurality of disks stacked one above the other such that the hollow base of a succeeding disk of said plurality of disks is received against the hollow base of a preceding disk, and the head of the preceding disk is removably received within the hollow base of the succeeding disk of said plurality of disks.

10. The combination recited in claim 9, wherein said plurality of play elements includes a plurality of beads stacked one above the other and lying in surrounding engagement with the distal end of said ball point pen cartridge.

* * * * *